US006992570B2

(12) United States Patent
Weinstein Ide

(10) Patent No.: US 6,992,570 B2
(45) Date of Patent: Jan. 31, 2006

(54) REST ROOM SOUND PRODUCING DEVICE

(76) Inventor: Linda A. Weinstein Ide, 555 Kappock St., Apt. 10E, Bronx, NY (US) 10463

( * ) Notice: Subject to any disclaimer, the term of this patent is extended or adjusted under 35 U.S.C. 154(b) by 79 days.

(21) Appl. No.: 10/443,416

(22) Filed: May 22, 2003

(65) Prior Publication Data

US 2003/0222785 A1 Dec. 4, 2003

Related U.S. Application Data

(60) Provisional application No. 60/384,015, filed on May 29, 2002.

(51) Int. Cl.
*G08B 3/00* (2006.01)

(52) U.S. Cl. ..... 340/384.1; 340/384.3; 340/384.7

(58) Field of Classification Search ..... 340/545.1, 340/545.6, 545.9, 384.1, 384.3, 384.7, 391.1, 340/392.3; 362/101, 184; 4/623, 661
See application file for complete search history.

(56) References Cited

U.S. PATENT DOCUMENTS

| | | | | |
|---|---|---|---|---|
| 4,521,919 | A | 6/1985 | Molloy | |
| 5,371,491 | A | 12/1994 | Wu | |
| 5,499,008 | A | 3/1996 | Rosenkrantz et al. | |
| D368,819 | S | 4/1996 | Lemmons | |
| 5,978,975 | A | 11/1999 | Asskaryar | |
| 6,203,164 | B1 * | 3/2001 | Tufekci et al. | 362/101 |

FOREIGN PATENT DOCUMENTS

| | | | |
|---|---|---|---|
| JP | 40-2248596 | A * | 10/1990 |
| JP | 07-280289 | A * | 10/1995 |
| JP | 04-116122 | A * | 4/2004 |

* cited by examiner

*Primary Examiner*—Van T. Trieu
(74) *Attorney, Agent, or Firm*—Roger M. Rathbun

(57) ABSTRACT

A sound producing device adapted for use in a public or private rest room. The device is located within the room, preferably mounted on a wall of a cubicle in the rest room and can be activated to produce a sound upon a person entering the cubicle such that the sound so produced covers up the normal bodily noises of a person using the rest room. In one embodiment, there are a plurality of cubicles with a single sound producing device that emanates sound into each of the cubicles and there is a sensor associated with at least substantially all of the plurality of cubicles.

20 Claims, 2 Drawing Sheets

REST ROOM SOUND PRODUCING DEVICE

RELATED PATENT APPLICATIONS

The present patent application is based upon Provisional patent application Ser. No. 60/384,015 filed May 29, 2002.

BACKGROUND OF THE INVENTION

The present invention relates to a sound producing device for restroom facilities, and, more particularly, to a sound producing device that can be affixed to the interior wall of a public or private restroom cubicle and which is activated by a person entering that cubicle.

In the use of a public rest room, there are normally cubicles within which the toilet is located, and which cubicles are provided with doors for the ingress and egress of the individual. When a person is within the cubicle, there are often noises associated with the elimination of waste products and which can be embarrassing to the person using the facilities.

Accordingly, there have been sound producing devices associated with individual toilets, such as the device that is shown and described in U.S. Pat. No. 4,521,919 of Molloy. The Molloy device is a small device adapted to be used with an individual toilet seat and is activated as the toilet seat is raised, however, a device that is activated by the raising of the toilet seat would not be particularly desirable for use in a cubicle of a public rest room.

It would, therefore, be advantageous to have a sound producing device better adapted to the use within the enclosed environment of a cubicle of a public or private rest room that can be secured to one of the walls of the secure environment and which can be activated by the presence of a person within that cubicle.

SUMMARY OF THE INVENTION

Accordingly, the present invention relates to a sound producing device for use in a bathroom or rest room facility, particularly with a cubicle surrounding walls and a door that can be moved between open and closed positions to allow the person ingress and egress to and from the cubicle.

The sound producing device is preferably affixed to one of the walls of the cubicle and the manner of affixation can vary depending upon the particular situation, and whether the rest room is a public or private facility.

There is an activation means that operates the sound device to enable it to emanate the desired sound, and the activation means may be a motion sensor that determines when a person has entered the cubicle of other means such as an optical, pneumatic, electrical or electro-mechanical sensor including a sensor that determines the closed position of the door or can be some sensor that responds to a weight imposed on the toilet or toilet seat.

In any event, the activation means, in some manner, senses the presence of a person within the cubicle or rest room and thereupon activates the sound producing device to emit a sound to cover up the normal noises of a person using the rest room facilities.

In one embodiment, the same sound producing device can be used for a series of cubicles in a public rest room and the sound will continue to be emitted for so long as one a sensor associated with each cubicle detects the presence of a person within that cubicle, thereby indicating that at least one person is utilizing the facilities.

These and other features and advantages of the present invention will become more readily apparent during the following detailed description taken in conjunction with the drawings herein.

DETAILED DESCRIPTION OF THE INVENTION

Figure 1:
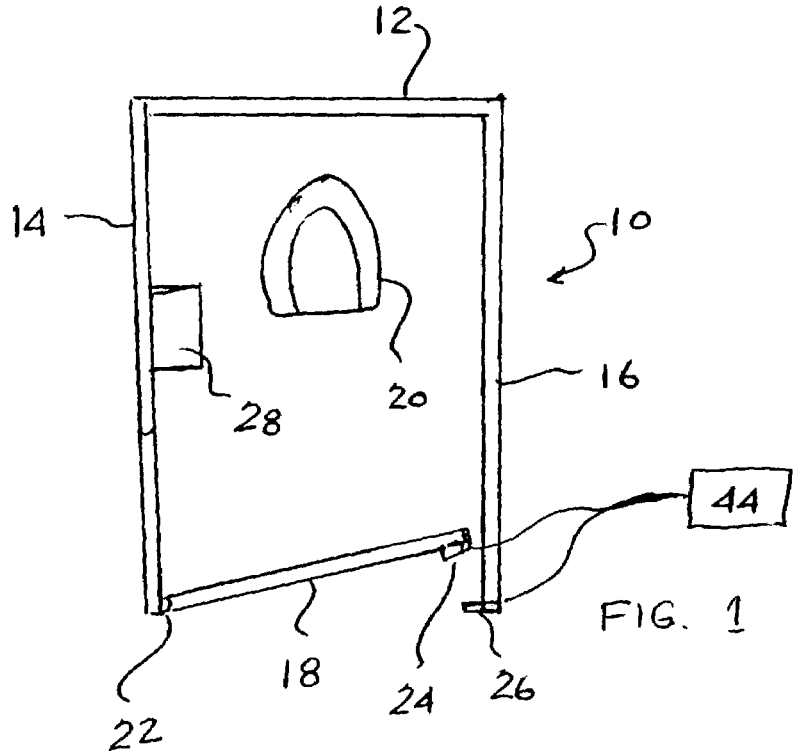
FIG. 1 is a top view of a cubicle of a public rest room.

Referring now to FIG. 1, there is shown a top view of a stall or cubicle 10 of a rest room, generally a public rest room but can be applicable to a private rest room. As can be seen, the cubicle 10 comprises a plurality of walls and includes a rear wall 12, side wall 14, side wall 16 and a door 18 such the combined walls 12, 14, 16 and the door 18 produce a private, enclosed environment for the person to relieve oneself. As also can be seen, there is a toilet 20 that is located within the enclosed environment of the cubicle 10.

As is conventional, the door 18 is hingedly affixed to one of the side walls, shown as side wall 14 so as to swing back and forth between a closed position, not shown, and an open position as shown in FIG. 1 to accommodate the ingress and egress of a person using the facilities and there is a hinge 22 or hinges to allow the movement of the door 18.

There is also a door latch 24 and a wall latch 26 that cooperate together so that the person can latch the door 18 in its closed position or, of course, open the door to enter or exit the enclosed environment when desired. In FIG. 1 there is also shown a sound producing device 28 that is affixed to the side wall 14 and its use will be later explained, it being noted, however, that the sound producing device 28 can provide a sound when a person is within the enclosed environment of the cubicle 10 to cover up the unwanted noises that occur when a person is being relieved therein.

The sound producing device 28 can be affixed to the side wall 14 by a variety of means, including an adhesive that may be pre-applied to the sound producing device 28, or may be a more permanent installation such as by screws, bolts or rivets designed so as to prevent the removal of the sound producing device 28 to the side wall 14.

Other means of affixing the sound producing device 28 can be by means of VELCRO fastening material, or the device may be hung on a hook over the door 16 of the cubicle 10 or the device may hang on a plastic or rope cord from a hook on the door 16 or one of the side walls 14, 16. Obviously, the means of affixing the sound producing device 28 to the cubicle depends on whether the cubicle 10 is located in a private structure or a public rest room since, if the latter, the means of affixation would need to be of a more permanent, theftproof nature.

Figure 2A:
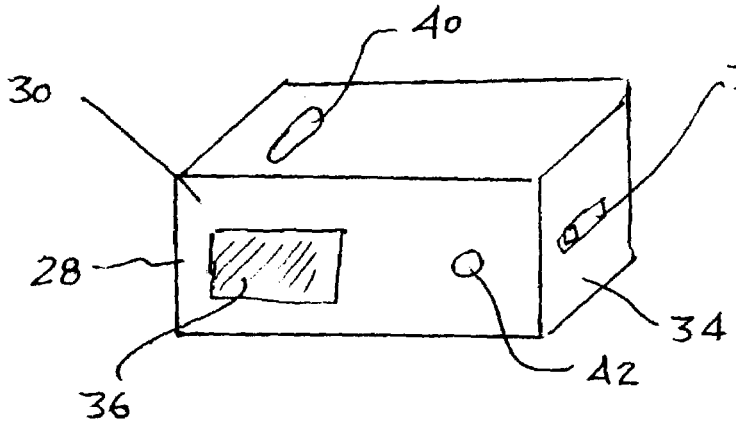
FIG. 2A is a front perspective view of a sound producing device that can be used with the present invention.
Figure 2B:
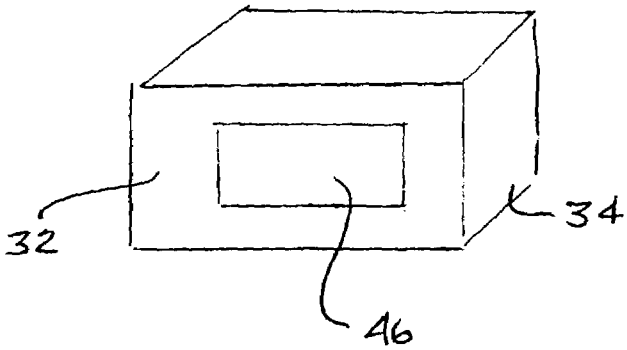
FIG. 2B is a rear perspective view of the sound producing device of FIG. 2A

Turning now to FIGS. 2A and 2B, taken along with FIG. 1, there is shown perspective views showing, respectively, the front 30 and the rear 32 of the sound producing device 10 of the present invention. In the sound producing device 28 there is a box 34 containing the sound producing components and which includes a speaker 36, an off-on switch 38, as well as a receptacle 40 for the insertion of batteries where the sound producing device 28 is not permanently attached to a source of electrical energy.

There is also an activation device that activates the sound producing device 28 to cause that sound producing device 28 to produce sounds to cover up the noises emanating from a person using the facilities. That activation device may be a motion sensor 42 that is responsive to the motion of a person entering and sitting within the enclosed environment within the cubicle 10 such that the sound producing device 28 creates a sound when a person enters the cubicle 10.

As an alternative, the activation device may be some electrical connection to a relay 44 that senses when the door latch 24 and wall latch 26 are in contact with each other indicating that the door 18 has been closed, the understanding being that a person has entered the cubicle 10. Accordingly, in such case, there can be a simple electrical connection made between the door latch 24 and the wall latch 26 to activate the sound producing device 28 to cause a sound to be generated to, again, cover up the otherwise embarrassing noises produced by a person using the facilities.

Other means can include some switch that is incorporated into the door lock such that when the person has entered the cubicle 10, and locks the door, the action of closing that lock will cause the activation of the sound producing device 28 or some weight sensor that senses the weight of a person sitting down upon the toilet or toilet seat. In general, the sensor can be optical, pneumatic, electronic, electro-mechanical or other technology the senses when a person has entered the rest room or the cubicle 10.

In FIG. 2B, there can be seen an adhesive area 46 that can be utilized to affix the sound producing device 28 to the side wall 12 of the cubicle 10. There may be, initially, a protective layer that covers the adhesive area 46 to protect the adhesive area 46 until the sound producing device 28 is ready to be affixed to the rear wall 12 or side walls 14, 16 of the cubicle 10.

The sound producing device itself may be of a variety of such devices including a radio, tape or diskette player, CD player or the like and, therefore, can be almost any device that produces a sound upon being activated and the sound may be pre-recorded on a chip, diskette, magnetic tape or other medium and the sound itself can be pre-recorded music or mood sounds, including classical music, pop music, or familiar kiddie tunes for a child's cubicle. Alternatively, there can be diskettes of differing music or mood sounds including sounds of a waterfall, a rain forest, a babbling brook or other soothing mood sounds.

Figure 3:
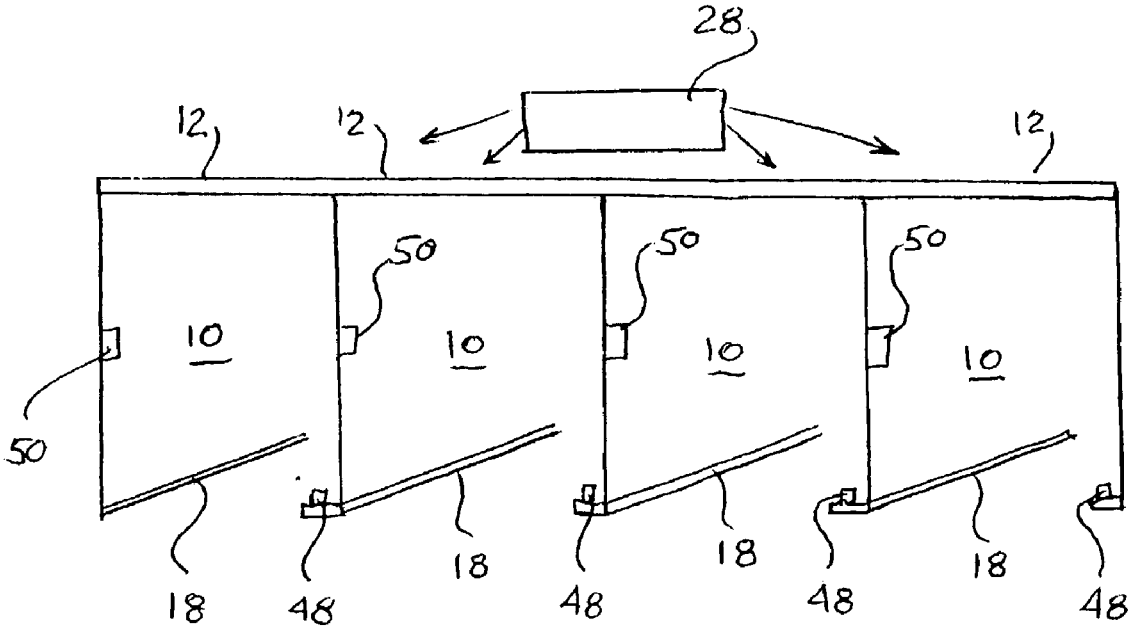
FIG. 3 is a top view of a plurality of cubicles in a public rest room with a single sound producing device that provides the sound for all of the cubicles.

Finally, in FIG. 3 there is shown a top view of an embodiment of the present invention wherein there are a plurality of individual cubicles 10 such as is typical in a public rest room. In such instance, it may be preferable to only have one sound producing device 28 that can produce a sound that is effective to cover the noises from each of the individual cubicles 10 rather than have a plurality of such sound producing devices 28 in each cubicle 10 where there can be a cacophony of differing sounds in the rest room.

Accordingly, with the FIG. 3 embodiment, the single sound producing device 28 can be used and which sound producing device 28 is located so as to be effective in all the individual cubicles 10. That location may, of course, be by vertically positioning the sound producing device 28 above the walls of the cubicles 10.

In any event, the control of the sound producing device 28 can be by means of a series of individual sensors located with each of the cubicles 10 that sense the presence of a person within that cubicle. The sensors may be individual electrical switches 48 that sense the position of each of the doors 18 or some motion detecting sensors 50 that detect the motion of a person within the cubicle. Whatever the particular sensor that is used, the control of the sound producing device 28 causes it to be activated as long as at least one of the sensors indicates the presence of a person in any one of the cubicles 10, that is, for example, as long as one of the doors 18 is in its closed position or at least one motion detecting sensor 50 detects the presence of a person, thereby indicating that at least one person is still utilizing the facilities.

Thus, the sound producing device 28 will remain activated in the event one or more persons is present within a cubicle 10 and will eventually be deactivated if all of the doors 18 are in their open positions or all of such other sensors fail to detect the presence of a person in any of the cubicles, thereby indicating that there is no one remaining in the rest room and, therefore, no need for the sound producing device 28 to be activated.

Those skilled in the art will readily recognize numerous adaptations and modifications which can be made to the rest room sound producing device and method of using the same of the present invention which will result in an improved process and device, yet all of which will fall within the scope and spirit of the present invention as defined in the following claims. Accordingly, the invention is to be limited only by the following claims and their equivalents.

I claim:

1. A cubicle for a rest room, said cubicle having a plurality of surrounding walls forming an enclosed environment and a door that is movable between an open position and a closed position for ingress and egress of a person, said cubicle containing a toilet within the enclosed environment, and a sound producing device located within the enclosed environment, and an activation device to activate the sound producing device to emit a sound when a person is present within the enclosed environment with sufficient volume to cover up noises produced by a person using the cubicle.

2. The cubicle for a rest room as defined in claim 1 wherein the sound producing device is affixed to a surrounding wall of the cubicle.

3. The cubicle for a rest room as defined in claim 1 wherein the sound producing device plays sounds from a pre-recorded medium.

4. The cubicle for a rest room as defined in claim 1 wherein the sound producing device has an adhesive backing to affix the sound producing device to a wall.

5. The cubicle for a rest room as defined in claim 1 wherein the activation device comprises a motion sensor responsive to the motion of a person within the enclosed environment.

6. The cubicle for a rest room as defined in claim 1 wherein the sound activation device is a sensor responsive to the closing of the door of the enclosed environment.

7. The cubicle for a rest room as defined in claim 1 wherein the sound activation device is a sensor responsive to the latching of the door latch when the door is in the closed position.

8. The cubicle for a rest room as defined in claim 1 wherein the rest room is a public rest room and the sound producing device is permanently affixed to a wall thereof.

9. The sound producing device as defined in claim 8 wherein the sound producing device is affixed by VELCRO material to the wall of the cubicle.

10. The sound producing device as defined in claim 8 wherein the rest room is a public rest room and the sound producing device is affixed to a wall in a permanent manner.

11. A sound producing device for use in a cubicle of a rest room forming a enclosed environment by a plurality of walls and a door that has an open position and a closed position, said sound producing device having an activation means that activates the sound producing device by a person within the closed environment of the cubicle to produce sound with sufficient volume to cover up noises produced by a person using the cubicle.

12. The sound producing device as defined in claim 11 wherein the sound activation device is a sensor responsive to the closing of the door of the enclosed environment.

13. The sound producing device as defined in claim 11 wherein the sound activation device is a sensor responsive to the motion of a person within the enclosed environment.

14. The sound producing device as defined in claim 11 wherein the sound producing device has a front surface and a rear surface and further has an adhesive area on its rear surface.

15. A method of providing sound within the enclosed environment formed by walls of a cubicle of a public rest room and having a door that is movable between and open and a closed position, the method comprising the steps of:

providing a sound producing device, locating the sound producing device within or proximate to the closed environment of the cubicle, activating the sound producing device by a person within the enclosed environment of the cubicle to cause sound emanating from the sound producing device to be of sufficient volume to cover sounds of a person within the enclosed environment.

16. The method as described in claim 15 wherein the step of activating the sound producing device comprises activating the sound producing device by the motion of a person within the enclosed environment of the cubicle.

17. A method as described in claim 15 wherein the step of activating the sound producing device comprises activating the sound producing device by the moving of the door to its closed position.

18. A plurality of cubicles for use in a public rest room, each of such cubicles having a door that is movable between an open position where the cubicle is accessible and a closed position whereby the cubicle is a confined area, and a sound producing device that is effective to produce sufficient sound to cover the normal sounds of a person utilizing any one of the plurality of cubicles, an activation means that activates the sound producing device by a person within the closed environment of the cubicle to produce sound with sufficient volume to cover up noises produced by a person using the cubicle.

19. A plurality of cubicles for use in a public rest room as defined in claim 18 wherein the activation device comprises an electrical switch that indicates when a door is in its closed position such that the sound producing device is activated if any of the doors of the plurality of cubicles is in its closed position.

20. A plurality of cubicles for use in a public rest room as defined in claim 18 wherein the at least some activation means is a motion detector that indicates when a person makes a motion within a cubicle such that the sound producing device is activated if any of the motion detectors detects the motion of a person within a cubicle.

* * * * *